United States Patent [19]

Davis et al.

[11] 4,263,014

[45] Apr. 21, 1981

[54] ANTI-RUST FUEL COMPOSITION

[75] Inventors: Marshall E. Davis, Poughkeepsie; Kenneth L. Dille, Wappingers Falls, both of N.Y.

[73] Assignee: Texaco Inc., White Plains, N.Y.

[21] Appl. No.: 918,542

[22] Filed: Jun. 23, 1978

[51] Int. Cl.[3] ..... C10L 1/14; C10M 1/40; C07C 3/00

[52] U.S. Cl. ..... 44/63; 252/33; 568/350

[58] Field of Search ..... 44/63; 568/350; 252/33

[56] References Cited

U.S. PATENT DOCUMENTS

| | | | |
|---|---|---|---|
| 2,632,695 | 3/1953 | Landis et al. | 44/66 |
| 3,347,645 | 10/1967 | Pietsch et al. | 44/63 |
| 3,445,386 | 5/1969 | Otto et al. | 44/63 |
| 3,779,724 | 12/1973 | Kerschner et al. | 44/63 |
| 3,864,098 | 2/1975 | Honnen | 44/63 |
| 3,997,569 | 12/1976 | Powell | 44/63 |

*Primary Examiner*—Winston A. Douglas
*Assistant Examiner*—Raymond K. Covington
*Attorney, Agent, or Firm*—Carl G. Ries; James J. O'Loughlin

[57] ABSTRACT

Anti-rust motor fuel composition comprising a major proportion of a mixture of hydrocarbons boiling in the gasoline boiling range, a minor amount of a polymeric acid comprising a dimer or trimer of a dienoic or trienoic acid containing from 16 to 18 carbon atoms and a minor amount of an aminoalkyl or polyalkyl polyamine imidazoline derivative of a hydrocarbon-substituted gamma or delta lactone reaction product.

4 Claims, No Drawings

ANTI-RUST FUEL COMPOSITION

BACKGROUND OF THE INVENTION

1. Field of the Invention

Modern gasoline compositions are highly refined products. Despite this, they contain minor amounts of impurities which tend to promote corrosion during the time that the bulk fuel is being transported or maintained in storage and also during the residence time in the fuel tank, fuel lines and carburetor of a motor vehicle. A commercial motor fuel composition must contain a corrosion inhibiting additive or additive combination to inhibit or prevent corrosion during the transport and storage of the bulk fuel and during its residence time in the fuel system of the motor vehicle.

Another problem with an additive-containing motor fuel composition is the susceptibility of the additive to extraction by the aqueous caustic bottoms in storage tanks and vessels. It is essential that the inhibitor retain its effectiveness through the entire transport phase of the fuel composition and at the same time not impair the properties of the fuel composition at the point of use.

Another problem faced by fuel manufacturers is the need to comply with exhaust gas emission requirements. The pertinent regulations specify maximum emissions levels for hydrocarbons, carbon monoxide and nitrogen oxides. It is essential that any additive employed in the fuel composition for one important function, such as for corrosion inhibition, not interfere with the requirement for low exhaust gas emissions. In general, the smallest quantity of an additive employed in a gasoline for a purpose as corrosion inhibition, the less likely will complication arise due to incomplete or imperfect combustion.

2. Description of the Prior Art

U.S. Pat. Nos. 2,632,695 and 3,658,496 disclose fuel compositions in which dimer or trimer acids have been employed.

A copending application Ser. No. 887,394 filed Mar. 16, 1978, discloses a motor fuel composition containing a lactono-imidazoline reaction product.

SUMMARY OF THE INVENTION

This invention pertains to a rust inhibited motor fuel composition comprising a mixture of hydrocarbons in the gasoline boiling range containing minor rust-inhibiting amounts of a polymeric dimer or trimer acid and a hydrocarbon-substituted lactono-imidazoline reaction product that are combined to allow interaction of acidic and basic entities prior to being added to gasoline.

More specifically, the novel motor fuel composition of the invention comprises a mixture of hydrocarbons in the motor fuel or gasoline boiling range containing in critical combination about 0.000003 to 0.0003 weight percent of a dimer or trimer of a dienoic or trienoic acid containing from 16 to 18 carbon atoms and from about 0.001 to 0.02 weight percent of a hydrocarbon-substituted lactono-imidazoline reaction product, said reaction product being obtained by reacting diethylenetriamine with a lactone reaction product, under amidation conditions at a temperature in the range of 80° C. to 170° C. employing about one to two moles of said amine per mole of said lactone reaction product, said lactone reaction product being obtained by treating a hydrocarbon succinic acid, represented by the formula:

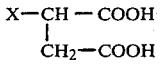

in which X is a hydrocarbon radical having an average molecular weight ranging from about 300 to 1500, under substantially anhydrous esterification conditions at a temperature ranging from about 50° to 100° C. in the presence of a protonating agent.

DESCRIPTION OF THE PREFERRED EMBODIMENTS

The polymer acid component of the additive combination of the invention comprises a dimer of a dienoic or trienoic acid containing from about 16 to 18 carbon atoms. Specific olefinic acids which can be employed are linoleic, linolenic, 9,11-octadecadienoic and eleostearic acids. Effective polymeric acids can be prepared from naturally occurring materials, such as linseed fatty acids, soya bean fatty acids and other natural unsaturated fatty acids. The preparation of polymeric acids is disclosed in U.S. Pat. No. 2,632,659. Suitable polymeric acids are available commercially, such as Empol 1022 "Dimer Acid," a dimer of linoleic acid. Dimer Acid, such as dilinoleic acid or Empol 1022 is well known as a rust inhibitor for a motor fuel composition and will provide a gasoline qualifying under the NACE Rust Test when employed in a concentration of 6 PTB (pounds of additive per 1000 barrels of fuel), i.e. about 0.002 weight percent.

The hydrocarbon-substituted lactono-imidazoline reaction product additive component of the invention is a detergent additive for motor fuel composition. It is prepared in a two-step process, i.e. via the preparation of an intermediate reaction product followed by the preparation of the additive component as described below.

PREPARATION OF THE INTERMEDIATE REACTION PRODUCT

The starting reactant from which the first reaction product or precursor obtained is a hydrocarbon-substituted succinic acid represented by the formula:

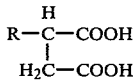

in which R is a hydrocarbyl or an alkenyl radical having an average molecular weight ranging from about 300 to 1500. The preferred hydrocarbon radical is an alkenyl radical derived from the polymerization of a $C_3$ to $C_4$ olefin, preferably propylene or isobutylene or mixture thereof, until a polymer in the prescribed molecular weight range is produced. A polymer of from about 325 to 500 average molecular weight is preferred as the source of the alkyl radical. This is treated with maleic anhydride to produce an alkenylsuccinic anhydride which is thereafter hydrolyzed to an alkenyl succinic acid. The polymerization of olefins, the reaction of the olefin polymer with maleic anhydride and subsequent hydrolysis to alkenylsuccinic acid are well known conventional processes and require no detailed description.

The prescribed hydrocarbon-substituted succinic acid is mixed with a catalyst to form a reaction mixture which is then heated to an elevated temperature to effect lactone formation.

The catalyst which is employed may be any protonating agent or electron pair acceptor i.e., any material which can provide a hydrogen ion or accept a pair of electrons to catalyze the reaction. The protonating agent or electron pair acceptor employed should provide from about 0.25 to 1.5 mole of protons or electrons acceptors per mole of the alkenylsuccinic acid being reacted although smaller or larger amounts can be employed with compromises in efficiency and/or economy. It is preferred to employ a protonating agent or electron pair acceptor which provides from about 0.5 to 1 moles of proton or electron pair per mole of alkenylsuccinic acid. These ranges can be also expressed as 0.25 to 1.5 or 0.5 to 1 equivalents of acid per mole of the alkenylsuccinic acid moiety. A variety of protonating agents or electron pair acceptors can be employed in the present process. Included among these are mineral acids, such as sulfuric acid and perchloric acid. Organic acids, including p-toluene sulfonic acid hydrate, boron trifluoride etherate and solid sulfonic acid ion exchange resins are also suitable.

The reaction is normally conducted at a temperature from about 50° C. up to about 100° C. with a range from about 60° to 100° C. being especially suitable. A preferred temperature range for this process is from about 70° to 98° C.

The following examples illustrate the preparation of the hydrocarbyl-substituted lactone reaction product precursor.

POLYISOBUTENYLSUCCINIC ANHYDRIDE REACTION PRODUCT

EXAMPLE I

To a solution of 126 g. (0.05 mole) of crude polyisobutenylsuccinic acid (prepared from polyisobutene of about 1300 molecular weight and maleic anhydride by thermal alkenylation with about 50% unreacted polyisobutene) in a 50 weight percent mineral oil solution was added 1.25 g. (0.0125 mole) of concentrated sulfuric acid.

The mixture containing about 0.0125 moles of sulfuric acid or about 0.025 moles of available protons. This mixture was held at 90° C. for three hours. Infrared analysis of the product from the foregoing reaction showed a high conversion to five-and-six membered lactones, with the yield estimated to be greater than 85 mole percent.

EXAMPLE II

A mixture of 2,570 g. (1.0 mole) of crude polyisobutylsuccinic anhydride (containing about 50% unreacted polyisobutene of about 1300 average molecular weight) and 25 g. (0.25 mole) of about 96% aqueous sulfuric acid and 18 g. (1.0 mole) of water were heated and stirred at 90° C. for about one hour and then allowed to cool to room temperature. The excess mineral acid can be removed by extraction but the product can also be used without further purification. Infrared analysis indicated high conversion to lactones as in Example I.

EXAMPLE III

A mixture of 824 g. (0.55 mole) of crude polyisobutylsuccinic anhydride (containing about 45% unreacted polybutene of about 625 average molecular weight) is heated to about 90° C. with stirring. Over a period of about four minutes, 21.5 g. of a solution consisting of 12.5 g. of about 96% sulfuric acid and 9.0 g. (0.5 mole) of water is added dropwise. After four hours the mixture is allowed to cool. This product will exhibit strong lactone absorptions in its infrared spectrum similar to Example I.

EXAMPLE IV

A mixture of 377.5 g. (0.5 mole) of crude polyisobutenylsuccinic anhydride (containing about 31% unreacted polyisobutene of about 325 average molecular weight) 12.5 g. (0.125 mole) of about 96% sulfuric acid, and 9.0 g. (0.5 mole) of water were heated to about 90° C. with stirring for one hour and allowed to cool. The product was washed free of mineral acidity by extraction and weighed 360.9 g. after handling-solvent evaporation. This product was characterized by a Sap. No. 157, a Neut. No. of 110; contained 0.19% sulfur and exhibited strong lactone absorption in its infrared spectrum as the product of Example I.

PREPARATION OF THE ADDITIVE REACTION PRODUCT

In the second step for preparing the additive composition of the invention, a gamma or delta lactone reaction product from the first step is caused to react with diethylenetriamine to produce a reaction product having an imidazoline structure.

The diethylenetriamine is caused to react with a gamma or delta lactone reaction product described in the first step above at an elevated temperature to produce a second reaction product which is the diethylenetriamine imidazoline-derivative of the hydrocarbon-substituted lactone precursor of the first reaction step.

A typical imidazoline derivative in the case of the more common gamma lactone is postulated to be represented by the following formula:

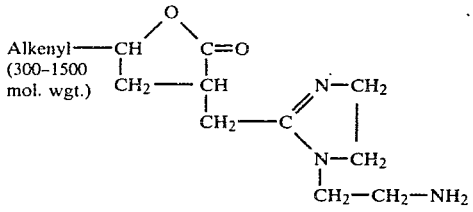

While reaction temperatures ranging from about 80° to 170° C. are effective to effect formation of the detergent additive of the invention it is preferred to conduct this reaction at a temperature ranging from about 120° to 150° C. The course of this reaction can be followed by collecting the water removed by the reaction and is conducted until the stoichiometric amount of water has been collected.

It is convenient to conduct this reaction in an inert diluent or solvent which will facilitate refluxing of the reactant within the indicated temperature range. In general, an inert hydrocarbon or mixture of hydrocarbons which is an effective solvent for the reactants and of a suitable boiling range is the preferred medium for effecting this reaction.

The diethylenetriamine and the hydrocarbon-substituted lactone reaction product react employing from about one to two moles of said amine per mole of said lactone reaction product with 1.5 moles of said amine being preferred. Other proportions can be employed but without advantage since the reactant in excess will generally remain unreacted.

The following examples illustrate the preparation of the additive reaction product of the invention.

EXAMPLE V

POLYISOBUTENYL (1290) LACTONO-AMINOETHYL IMIDAZOLINE PRODUCT

To 105.4 lbs. of polyisobutenyl (1290) lactono carboxylic acid in 132 lbs. of xylene is added 8.3 lbs. of diethylene triamine. The molar ratio of amine to acid is 1.46. The mixture is heated to 293° F. and held there for 9 hours. About 3.3 lbs. of water is collected. The reaction mixture is allowed to cool to room temperature to permit settling of sludge (amine salt of sulfuric acid). The reaction mixture is filtered, and the xylene removed from the filtrate under reduced pressure. The additive analyses for this product were as follows:

| | |
|---|---|
| Mod. Neut. No. | 2.2 |
| Sap. No. | 10.9 |
| TBN | 40.00 |
| Furol Vis. | 1580 |
| % S | 0.064 |
| % N | 1.89 |
| Mol Wt. | 1900 |

The infrared absorptions at 5.65μ (microns) (lactono) and 6.25 (imidazolino) show that the above additive is formed.

EXAMPLE VI

2-POLYISOBUTENYL (1290) LACTONO-1-(DIETHYLENE DIAMINO IMIDAZOLINE

To 1.13 lbs. of polyisobutenyl (1290) lactono carboxylic acid in 0.82 lbs. of xylene is added 0.08 lbs. of diethylene triamine. The molar ratio of amine to acid is 1.44. The mixture is heated to 290° F. and held there for 6 hours. After 0.2 lbs. of water is collected. The reaction mixture is allowed to cool to room temperature to permit settling of sludge (amine salt of sulfuric acid). The reaction mixture is filtered, and the xylene removed from the filtrate under reduced pressure. The additive analyses for this product were as follows:

The analysis of the product was as follows:

| | |
|---|---|
| Sap. No. | 10.1 |
| Mod. Neut. No. | 2.4 |
| TBN | 41.8 |
| % N | 2.14 |
| % S | 0.086 |

The infrared absorptions at 5.65 (lactono) and 6.25μ (imidazolino) show that the above additive is formed.

EXAMPLE VII

2-POLYISOBUTENYL (1290) LACTONE-1-(TRIETHYLENE TRIAMINO IMIDAZOLINE

To 0.48 lbs. of polyisobutenyl (1290) lactono carboxylic acid in 0.41 lbs. of xylene is added 0.04 lbs. of diethylene triamine. The molar ratio of amine to acid is 1.38. The mixture is heated to 290° F. and held there for 4 hours. After 0.01 lbs. of water is collected. The reaction mixture is allowed to cool to room temperature to permit settling of sludge (amine salt of sulfuric acid). The reaction mixture is filtered, and the xylene removed from the filtrate under reduced pressure. The additive analyses for this product were as follows:

| | |
|---|---|
| Sap. No. | 18.2 |
| Mod. Neut. No. | 7.1 |
| TBN | 59.5 |
| % N | 3.04 |
| % S | 0.21 |

The infrared absorptions at 5.65μ (lactono) and 6.25μ (imidazolino) show that the above additive is formed.

The objective of the novel fuel composition of the invention is to provide a motor fuel composition which will pass the National Association of Corrosion Engineers Standard TM-01-72 (NACE) Rust Test with a minimum amount of rust inhibitor additive. A passing rust rating in this test is a rating of "Trace" or a trace amount of rust. If the major proportion of the treated motor fuel composition has a test rust rating of trace, the fuel composition is judged as having a passing anti-rust rating.

The base fuel employed for preparing the motor fuel composition of the invention comprises a mixture of hydrocarbons boiling in the gasoline boiling range, i.e., from about 90° to 400° F. This base fuel may consist of straight chain or branched chain paraffins, cycloparaffins, olefins, aromatic hydrocarbons or any mixture of these. The base fuel can be derived from straight run naphtha, polymer gasoline, natural gasoline or from catalytically cracked or thermally cracked hydrocarbons and catalytically reformed stocks.

The composition of hydrocarbon components of the base fuel is not critical nor does the octane level of the base fuel have any material effect on the invention.

The fuel composition may contain any of the additives normally employed in gasoline. Thus, the fuel composition can contain an anti-knock compound such as tetraalkyl lead compound, including tetraethylead, tetramethyllead, tetrabutyllead and mixtures thereof. The fuel composition can also contain anti-icing additives, dyes, upper cylinder lubricating oils and the like. The dimer or trimer acid component of the additive combination of the invention is employed in a concentration range of from 0.000003 to 0.0003 weight percent, amounts corresponding to about 0.009 and 0.9 PTB. The preferred concentration of this component is from 0.000003 to 0.0001 corresponding to about 0.09 to 0.3 PTB.

The lactono-imidazoline component of the additive combination in the novel fuel composition is employed in a concentration range of about 0.0001 to 0.02 weight percent, which corresponds to about 3 and 50 PTB. The preferred concentration range from the lactono-imidazoline component is from 0.002 to 0.01 weight percent. Additive A was a 60 percent active solution of 2-polyisobutenyl (335 mol. wgt.) lactono-1-aminoethyl-imidazoline in unreacted polyisobutylene.

The base fuel employed in the following examples was a lead-free gasoline having a Research Octane Number of about 91. This gasoline consisted of about 10 percent olefinic hydrocarbon and 60 percent paraffinic hydrocarbons and boiled in the range from about 90° F. to 370° F.

The anti-rust properties of the fuel composition of the invention and of a comparison fuel composition in the NACE Rust Test is shown in the following Table. The amount of additive added to the Base Fuel is given in pounds per thousand barrels (PTB).

TABLE I

| | NACE RUST TEST | | |
|---|---|---|---|
| Run | Dimer Acid[1] PTB | Additive A PTB | NACE Rust Rating Percent of Fuel With More than a Trace of Rust |
| 1. | 0.25 | — | 100 |
| 2. | — | 10 | 78 |
| 3. | 0.25 | 10 | 18 |

[1]Approximately 85% dimeric acids and 12% trimeric acids of $C_{16}$–$C_{18}$ dienoic or trienoic acid, i.e. Emery Empol 1022

The fuel composition of Run 1, wherein Dimer Acid was employed failed the NACE Rust Test 100 percent of the time. The fuel composition of Run 2 failed the NACE Rust Test 78 percent of the time. The fuel composition of Run 3, which is representative of the present invention was outstandingly effective with a NACE Rust Test pass-fail ratio of 82 percent to 18 percent. This result was totally unexpected from the known characteristics of the additives employed.

We claim:

1. A motor fuel composition comprising a mixture of hydrocarbons in the gasoline boiling range containing from about 0.000003 to 0.0003 to weight percent of a polymeric acid comprising a dimer or trimer of a dienoic or trienoic acid containing from 16 to 18 carbon atoms and from about 0.001 to 0.02 weight percent of a hydrocarbon-substituted lactono-imidazoline reaction product, said reaction product being obtained by reacting diethylenetriamine with a lactone reaction product under amidation conditions at a temperature in the range of 80° C. to 170° C. employing about one to two moles of said amine per mole of said lactone reaction product, said lactone reaction product being obtained by treating a hydrocarbon succinic acid, represented by the formula:

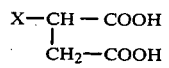

in which X is a hydrocarbon radical having an average molecular weight ranging from about 300 to 1500, under substantially anhydrous esterification conditions at a temperature ranging from about 50° to 100° C. in the presence of a protonating agent.

2. A motor fuel composition according to claim 1 in which said polymeric acid is present in the range from 0.000003 to 0.0001 weight percent and said lactono-imidazoline reaction product is present in the range from about 0.001 to 0.02 weight percent.

3. A motor fuel composition according to claim 1 in which said polymeric acid is predominantly the dimer of linoleic acid.

4. A motor fuel composition according to claim 1 in which said lactono reaction product is 2-polyisobutenyl (335 mol. wgt.) lactono-1-aminoethylimidazoline.

* * * * *

UNITED STATES PATENT AND TRADEMARK OFFICE

CERTIFICATE OF CORRECTION

PATENT NO. : 4,263,014

DATED : April 21, 1981

INVENTOR(S) : Marshall E. Davis and Kenneth L. Dille

It is certified that error appears in the above—identified patent and that said Letters Patent is hereby corrected as shown below:

Claim 2, column 8, line 22, "0.000003" should read --0.00003--.

Signed and Sealed this

*Fourteenth* Day of *July 1981*

[SEAL]

*Attest:*

GERALD J. MOSSINGHOFF

*Attesting Officer*

*Commissioner of Patents and Trademarks*